US007791496B2

(12) United States Patent
Anderson et al.

(10) Patent No.: US 7,791,496 B2
(45) **Date of Patent: *Sep. 7, 2010**

(54) PLUG-IN SPEAKER FOR EMERGENCY NOTIFICATION AND VOICE EVACUATION

(75) Inventors: Douglas J. Anderson, St. Charles, IL (US); Curtis R. Davidson, Oswego, IL (US); Bojana Vojinovic, Elmhurst, IL (US)

(73) Assignee: Honeywell International Inc., Morristown, NJ (US)

( * ) Notice: Subject to any disclaimer, the term of this patent is extended or adjusted under 35 U.S.C. 154(b) by 418 days.

This patent is subject to a terminal disclaimer.

(21) Appl. No.: 11/770,244

(22) Filed: Jun. 28, 2007

(65) Prior Publication Data

US 2008/0157992 A1 Jul. 3, 2008

Related U.S. Application Data

(63) Continuation-in-part of application No. 11/535,760, filed on Sep. 27, 2006.

(51) Int. Cl.

| | |
|---|---|
| ***G08B 7/00*** | (2006.01) |
| ***G08B 5/36*** | (2006.01) |
| ***G08B 3/10*** | (2006.01) |
| ***G08B 21/00*** | (2006.01) |

(52) U.S. Cl. ..... 340/691.1; 340/815.47; 340/384.7; 340/687

(58) Field of Classification Search ..... 340/384.7, 340/691.1, 815.47, 687

See application file for complete search history.

(56) References Cited

U.S. PATENT DOCUMENTS

| | | | | |
|---|---|---|---|---|
| 3,892,934 | A * | 7/1975 | Richards et al. | 200/288 |
| 5,808,556 | A * | 9/1998 | Nelson et al. | 340/693.6 |
| 5,817,999 | A * | 10/1998 | Mugan et al. | 200/50.11 |
| 5,914,665 | A | 6/1999 | Thorp | |
| 5,931,569 | A | 8/1999 | Anderson | |
| D424,465 | S | 5/2000 | Davidson | |
| 6,057,778 | A | 5/2000 | Davidson | |
| 6,127,935 | A * | 10/2000 | Davidson et al. | 340/691.5 |
| 6,133,843 | A | 10/2000 | Davidson | |
| 6,522,261 | B2 | 2/2003 | Scheffler | |

(Continued)

FOREIGN PATENT DOCUMENTS

EP 0 567 820 A1 11/1993

(Continued)

OTHER PUBLICATIONS

Gentex Manual, available at http://www.gentex.com/pdf/manuals/(550-0249-07)GE3Series.pdf, May 5, 2002.

(Continued)

*Primary Examiner*—Benjamin C Lee
*Assistant Examiner*—Cal Eustaquio
(74) *Attorney, Agent, or Firm*—Husch Blackwell Sanders Welsh & Katz

(57) ABSTRACT

An alarm indicating output appliance can be releasably affixed to a mounting plate. The plate carries wire receiving terminals which couple to the appliance. In the absence of the appliance, at least two of the terminals can be short circuited.

14 Claims, 16 Drawing Sheets

U.S. PATENT DOCUMENTS

| | | | | |
|---|---|---|---|---|
| 6,538,571 | B1 | 3/2003 | Huang | |
| 7,173,525 | B2 * | 2/2007 | Albert | 340/521 |
| 7,183,483 | B1 * | 2/2007 | Anderson et al. | 174/50 |

FOREIGN PATENT DOCUMENTS

| | | |
|---|---|---|
| JP | 7-85384 | 3/1995 |

OTHER PUBLICATIONS

Gentex Brochure, available at http://www.gentex.com/pdf/data_sheets/GEC06014pg_Layout1A.pdf, date is more than 1 year before filing date of present application.

System Sensor Selectable Output Strobes, Horns, and Horn/Strobes Installation and Maintenance Instructions, published before Sep. 27, 2006.

Abstract for JP Publication No. 07-085384 published Mar. 31, 1995 (1 page).

* cited by examiner

SPEAKER/ STROBE

PLUG-IN SPEAKER FOR EMERGENCY NOTIFICATION AND VOICE EVACUATION

CROSS-REFERENCE TO RELATED APPLICATION

This application is a continuation-in-part of and claims the benefit of the filing date of U.S. patent application Ser. No. 11/535,760 filed Sep. 27, 2006, and entitled "PLUG-IN ALARM NOTIFICATION DEVICE" which is incorporated herein by reference.

FIELD

The invention pertains to alarm notification devices that can output audible messages and/or visual alarm indicators. More particularly, the invention pertains to wall mountable loud speakers or speaker/strobe units or devices which releasably engage a base which has been hardwired into an alarm or public address system.

BACKGROUND

Power and or signaling wires for fire notification devices are usually connected directly to the product. The product is then attached to a mounting base. The fact that the product is directly wired makes it more difficult to replace a malfunctioning unit. Additionally, up to twelve, eight gage wires may be used to power the product. The direct wiring of so many large gage wires makes attachment of the product to the mounting base much more difficult. Furthermore, testing and troubleshooting the system is much more difficult. It is difficult to determine whether a system problem is product or wiring related.

There is thus a need for structures that facilitate such connections and disconnections. Further, it would be desirable to be able to more readily check wiring than has been possible in the past.

DETAILED DESCRIPTION

Figure 1:
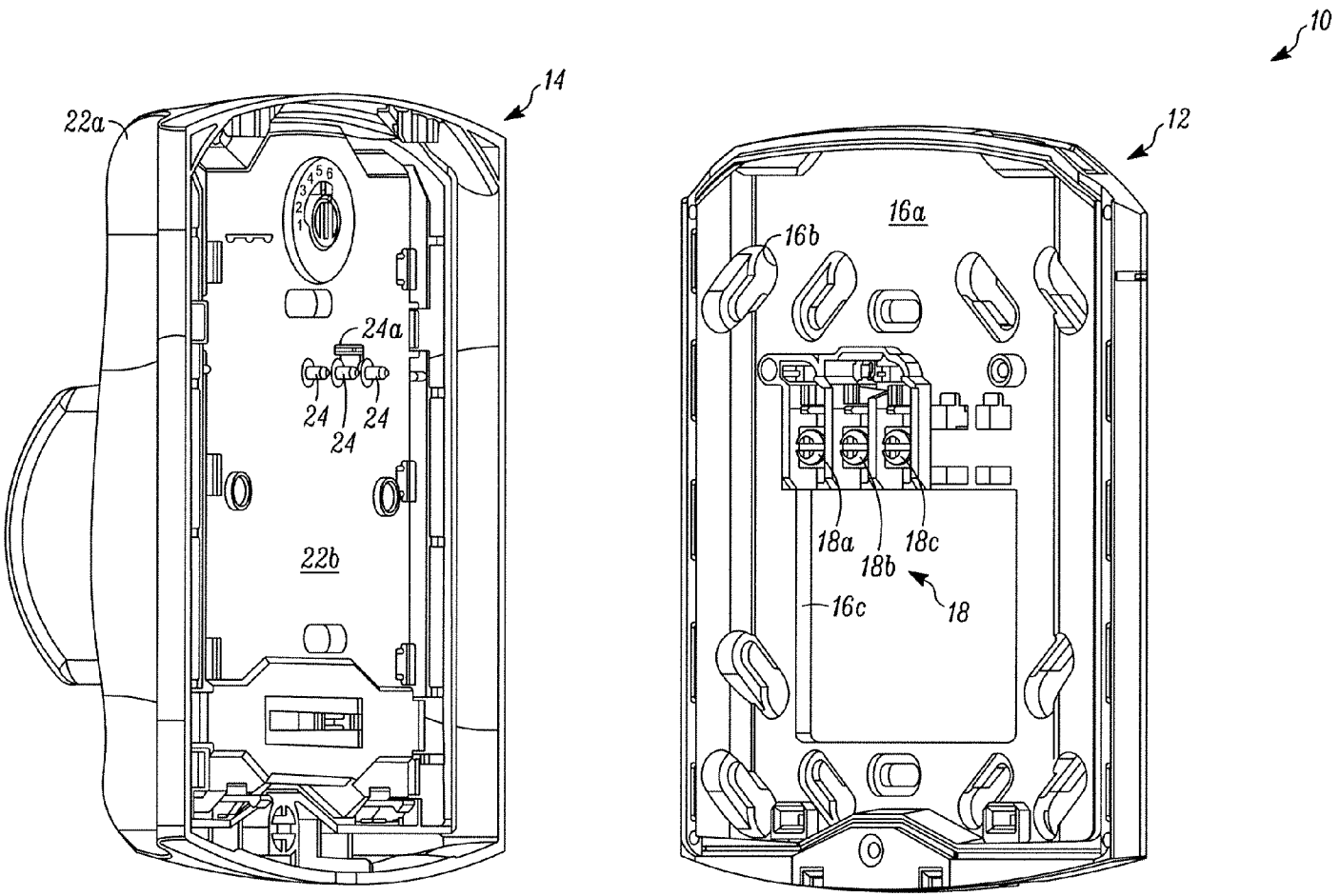
FIG. 1 illustrates a multi-element apparatus in accordance with the invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

One embodiment includes a fire notification appliance which includes a speaker which can emit verbal messages and a mounting base. The mounting base carries wiring terminals. Another embodiment includes a speaker and a strobe.

The base can be mounted to an electrical junction box. Alarm system wires are connected to the wiring terminals of the base. The notification appliance makes contact with those terminals upon installation of the product to the base. That contact can be made through a variety of structures including pins, blades, and the like, all without limitation.

If the appliance needs to be replaced, it can be removed from the base and another can be put in its place, without detaching the power wires. The base can also contain a shorting contact spring connecting, for example, positive "in" and positive "out" terminals. This structure enables an installer to check for wiring continuity prior to installing the product, simplifying the installation process.

In one aspect of the invention, the shorting spring can have a locking feature that causes the contact to remain open if the product is removed. This would then cause an open circuit trouble condition at the fire panel alerting the proper personnel that a fire notification unit had been removed.

Finally, the wires can be neatly dressed into the box allowing ample room within the box and unimpeded product installation.

The mounting base could have several embodiments. First, it could be formed as an injection molded plastic part with metal terminals pressed into positions that are aligned with the power pins or blades emanating from the product. Another embodiment could include a metal plate with an insulated terminal block attached such that it aligns with the power pins.

The product could contain a printed circuit board to which power connection pins or blades are soldered either individually or as a pin header assembly. The pins or blades would protrude through a back protective cover of the appliance and extend far enough to make contact with the terminals on the base. The contact can be made by a variety of methods including a jack and plug style, or pressure/friction contact, etc. This contact provides power to the appliance.

In a disclosed configuration, the appliance can be moved into releasable engagement with the base along a line generally perpendicular to the base or along a line generally parallel to the base. In either embodiment, the appliance open circuits the shorting spring.

In another aspect of the invention, removal of the appliance can leave the spring in an open circuited state. The spring can be short circuited to check system wiring.

FIG. 1 illustrates an embodiment of the present invention, an apparatus 10. The apparatus 10 includes a mounting plate generally indicated at 12 and an associated electrical unit indicated generally at 14. The mounting plate 12 is of a type which could be releasably attached to an electrical box into which electrical wires have been drawn. Such electrical wires could be associated with an alarm monitoring system with the wires particularly being associated with energizing and controlling alarm indicating output appliances such as horns, strobes, combination horn/strobes, loud speakers, and the like, all without limitation.

Electrical unit 14 is a representative one of the respective appliances. The unit 14 can be elongated, square, cylindrical or any other convenient shape without limitation.

The mounting plate 12 has a generally planar shape with a central section 16*a* which could be formed of molded plastic with various openings, such as 16*b* formed therein to make it convenient to attach the plate 12 to the respective electrical box.

The plate 12 also divides an internal opening 16*c* through which electrical wires noted above could be drawn and in turn connected to power supply terminals indicated generally at 18.

The plate 12 can support various numbers of power supply terminals, the three terminals 18*a, b* and *c* illustrated in FIG. 1 are representative only. Additional numbers such as five or six terminals can also be supported by the mounting plate 12. Those of skill in the art will understand that the number of terminals is not a limitation of the present invention.

The terminals are illustrated as screw type terminals in the embodiment of FIG. 1. It will also be understood that other types of terminal configurations such as push in terminals and the like which don't necessarily require screws come within the spirit and scope of the present invention. The terminals 18 are metallic as is conventional.

Electrical unit 14 includes a hollow exterior housing 22*a* with a generally planar surface 22*b* which closes an open side of the housing 22*a*. The representative electrical unit 14 illustrated in FIG. 1 is a strobe unit. The member 22*b* can be used with a plurality of differed shaped housings 22*a* such elongated, square, cylindrical all without limitation.

Those of skill in the art will understand that the unit 14 can be placed on and connected to the plate 12. The plate 12 supplies a convenient and advantageous structure wherein the electrical wiring associated with the alarm system is brought into the box, then through the opening 16*c* and connected to the terminals 18. Some of the terminals 18 can provide electrical signals or electrical energy to the unit 14 all without limitation.

The unit 14 carries a plurality of contact pins 24 which extend through openings in the cover 22*b* of the housing 22*a*. The pins 24 are coupled to electrical circuitry carried in the housing 22*a* which can for example energize the respective strobe light periodically as would be understood by those of skill in the art, activate a horn or a loud speaker if desired as well.

Figure 2:
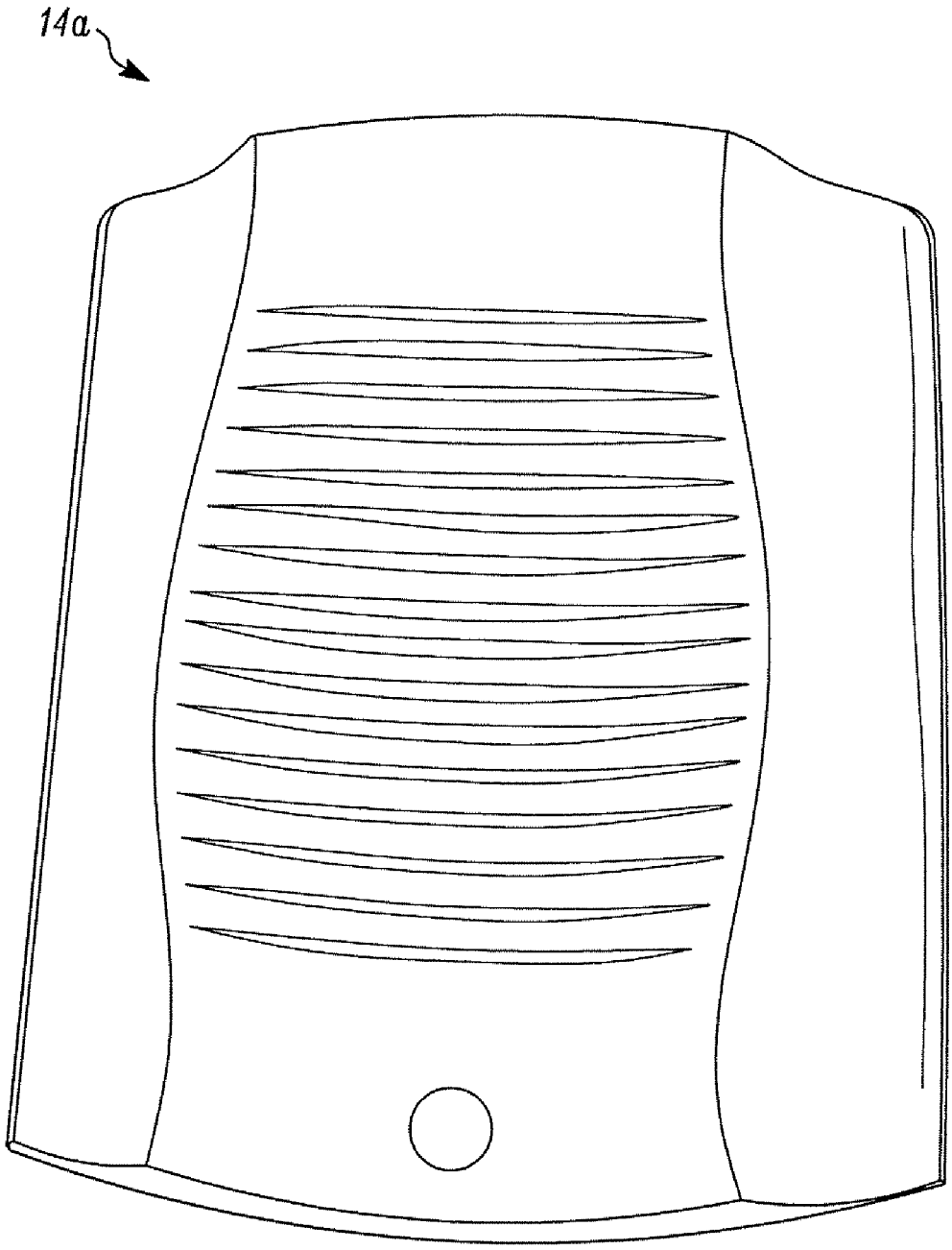
FIG. 2 illustrates a speaker or a horn unit usable in connection with the apparatus of FIG. 1.
Figure 3:
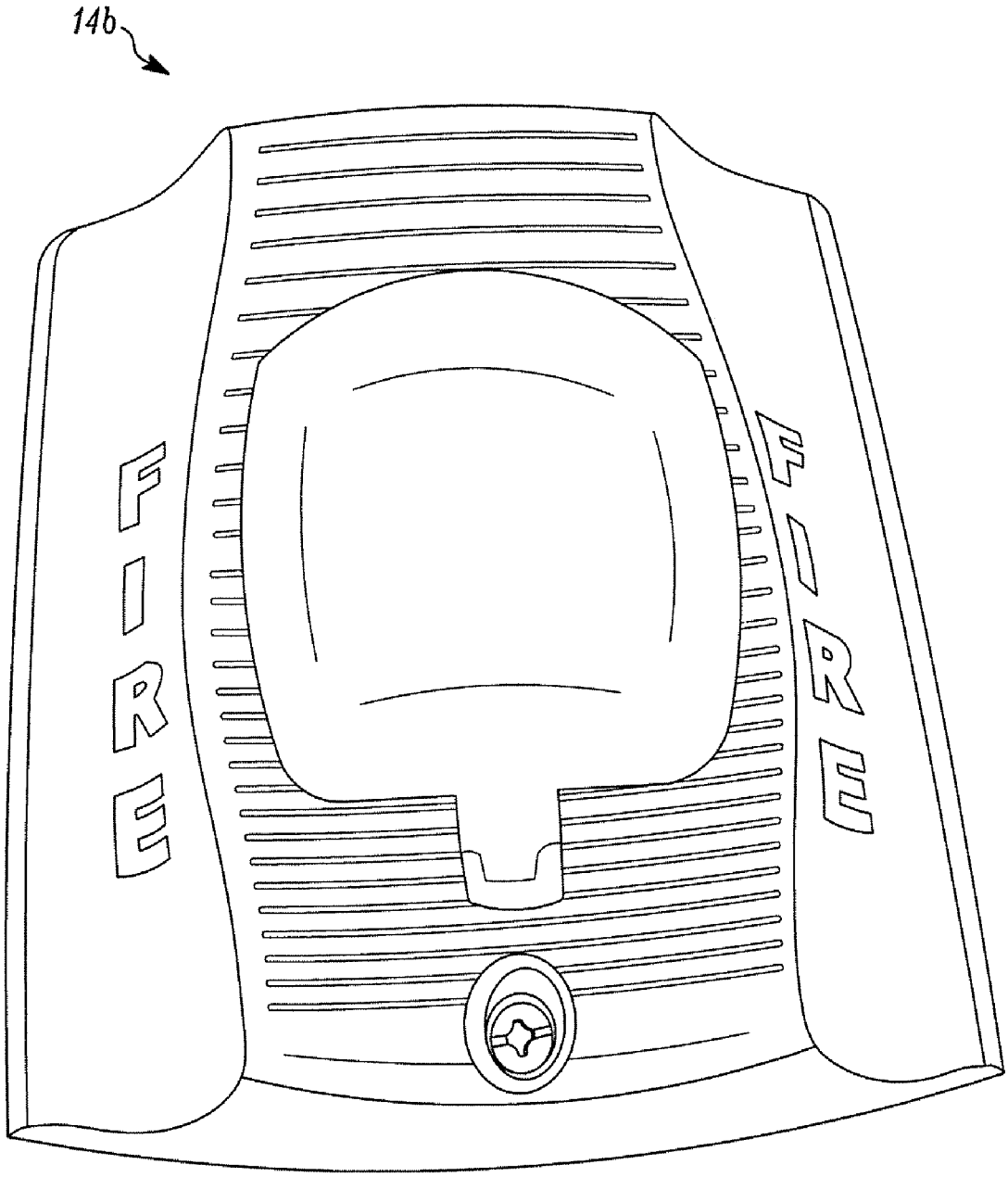
FIG. 3 illustrates a strobe unit usable with the apparatus of FIG. 1.

FIG. 2 illustrates a representative speaker or horn unit 14*a* which can be coupled to the plate 12 and powered off of the terminals 18. FIG. 3 illustrates a representative strobe 14*b* which can also be coupled to a plate such as the plate 12 and energized off of power supply terminals such as terminals 18.

Figure 4:
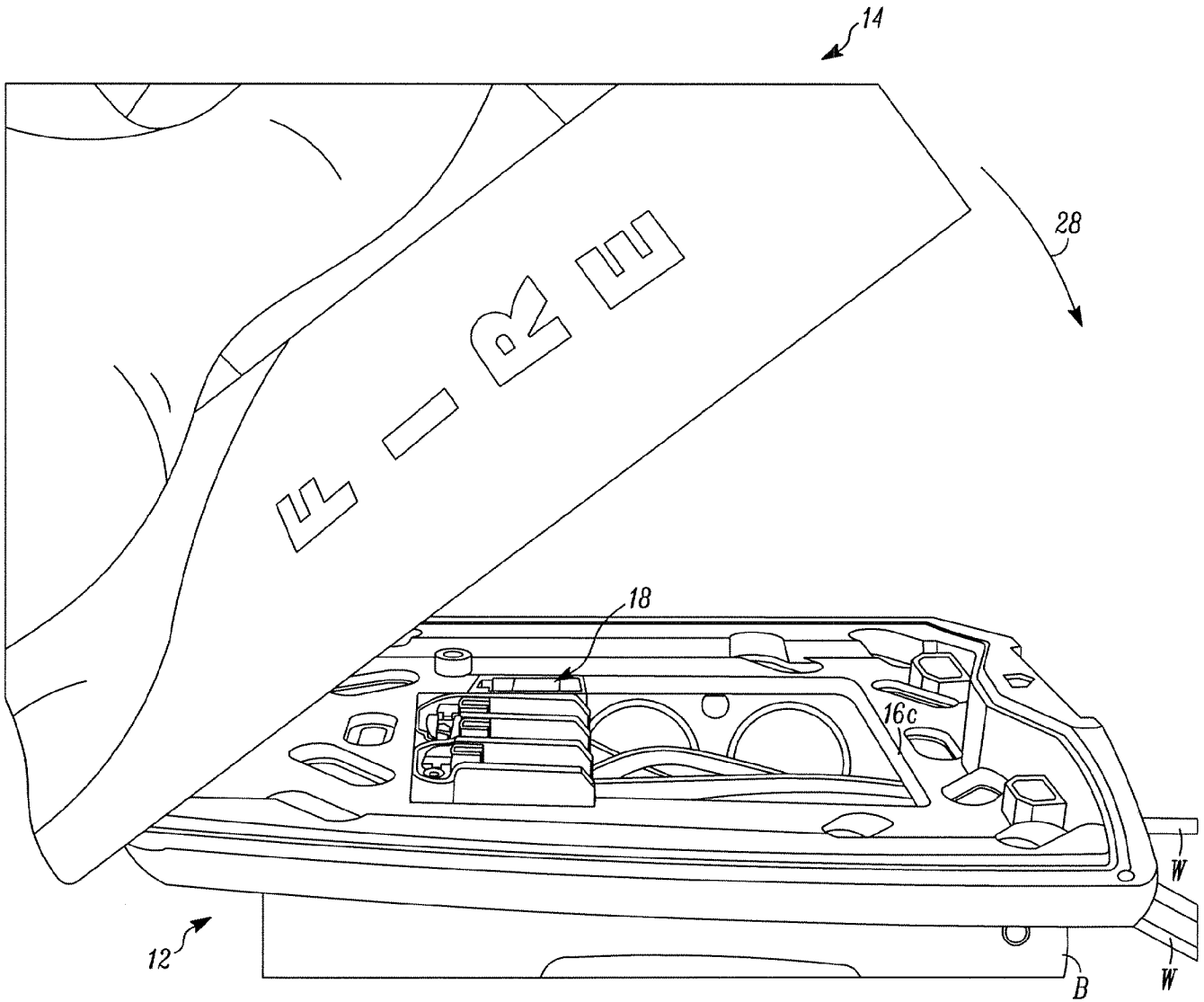
FIG. 4 is a view illustrating the elements of the apparatus of FIG. 1 being positioned in contact with one another.

As illustrated in FIG. 4, contact pins 24 of unit 14 (as in FIG. 1) can be brought into contact with the terminals 18 of the plate 12 via rotating the unit 14 in a direction indicated generally at 28. The direction 28 while arcuate is not a limitation of the present invention. The plate 12 could be configured such that the unit 14 is linearly moved into contact with the plate 12. In the configuration of FIG. 4, the unit 14 moves in a direction which is along a line which intersects the plate 12.

Alternately to the configuration of FIG. 4, those of skill will understand that the unit 14 could be moved laterally relative to the plate 12 generally along a line which is parallel to plate 12. The unit 14 can also be rotatably coupled to the plate 12 if desired.

FIG. 4 illustrates the plate 12 attached to a box B with wires W extending into the box B. The wires W extend through the opening 16*c* and can be coupled to the terminals 18, best seen in FIG. 7.

Figure 5A:
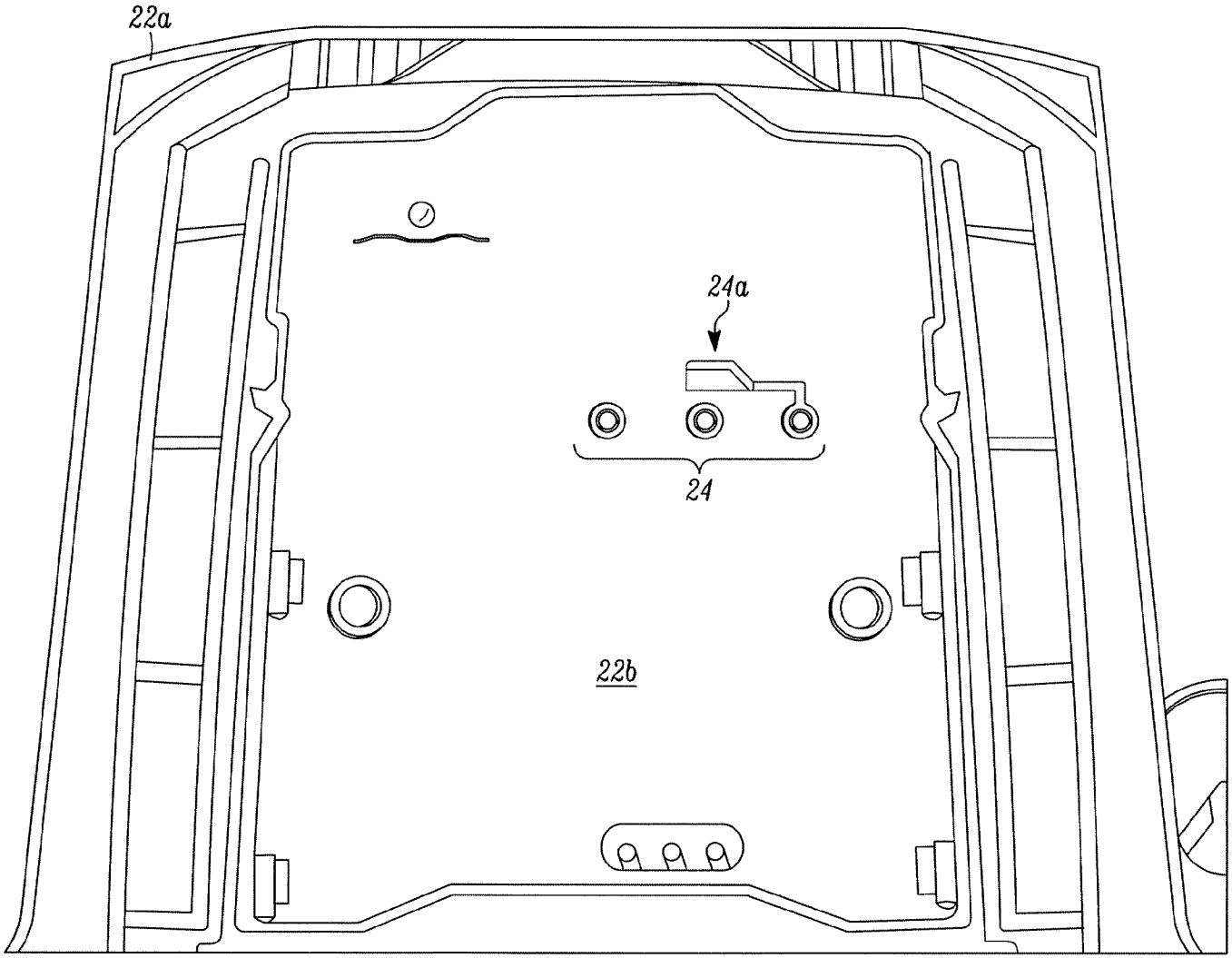
FIG. 5A illustrates one pin configuration of an electrical unit in accordance with the invention.

FIG. 5A illustrates a configuration of pins 24 with a plurality of pins, such as three pins extending from the surface 22*b* which closes the housing 22*a*. A contact member 24*a* is adjacent to the connecting pins 24. It will be understood that the exact shape of the pins 24 is not a limitation of the present invention. While illustrated cylindrically, other contact shapes and numbers of contacts come within the spirit and scope of the invention.

Figure 5B:
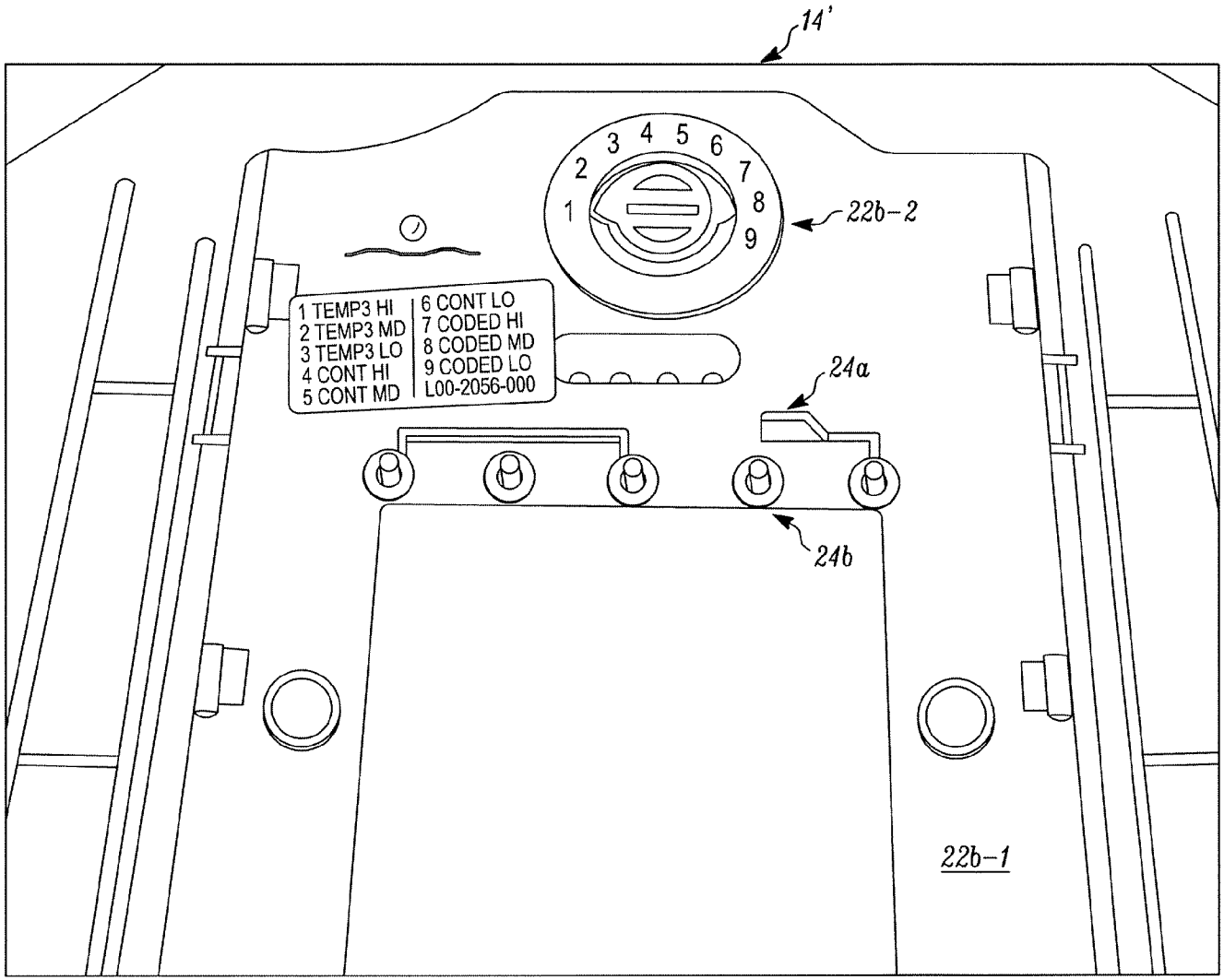
FIG. 5B illustrates a different pin configuration of an electrical unit in accordance with the invention.

FIG. 5B illustrates an alternate configuration of contact elements or pins 24*b* which includes multiple, for example six, contact members. The five contact members 24*b* can be coupled to circuitry within the unit 14' which can carry both a strobe and an audio output device such as horn or loud speaker. An audio output adjustment element 22*b*-2 can be provided on the member 22*b*-1.

Figure 6:
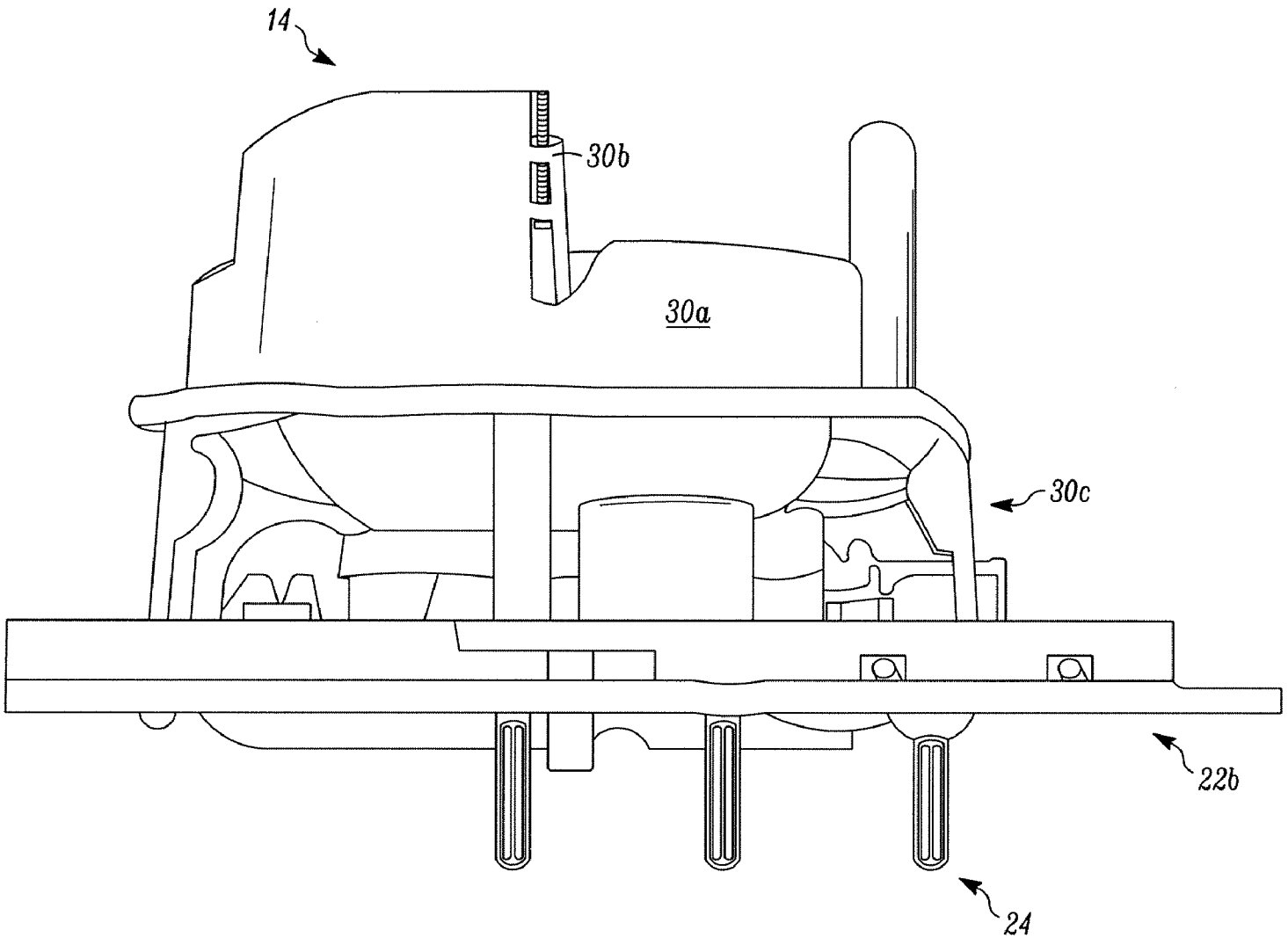
FIG. 6 illustrates control circuitry and other elements of the unit of FIG. 5A.

FIG. 6 illustrates the unit 14 with the cover or housing 22*a* removed. As illustrated therein the plurality of contact pins 24 extends from the planar member 22*b*. The member 22*b* also carries a reflector 30*a*, a strobe light 30*b*, and associated control circuitry 30*c*. The control circuitry 30*c* which can include a power supply can receive electrical energy via the wires W and at least one of the members of the plurality 24.

Figure 7:
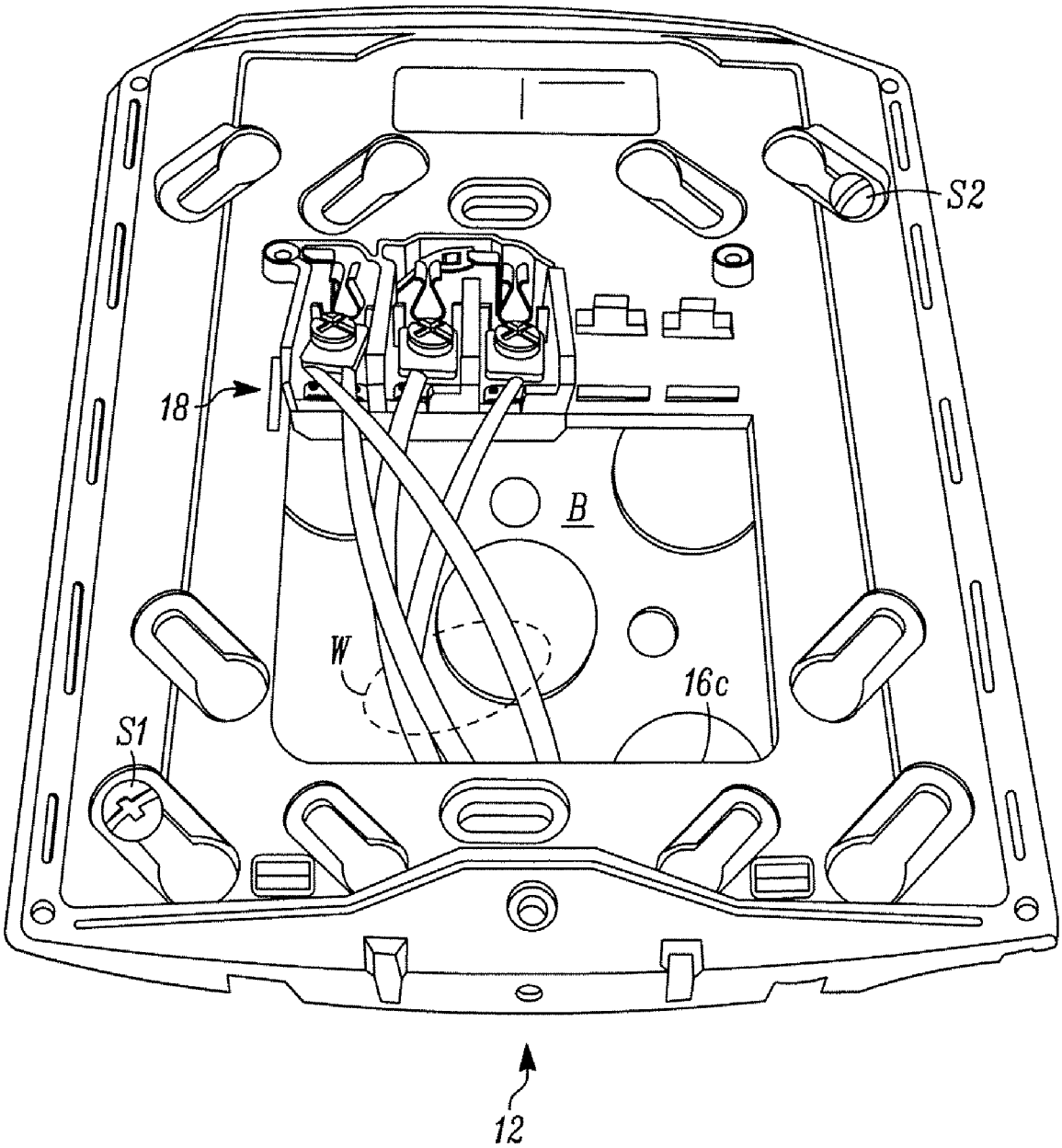
FIG. 7 illustrates one of the elements of FIG. 1 mounted on an electrical box and with wires coupled thereto.

FIG. 7 illustrates the plate 12 attached to the box B with the wires W extending through the opening 16*c*. As illustrated in FIG. 7, the plate 12 can be attached via screws such as screws S1, S2 to the box B.

Figure 8A:
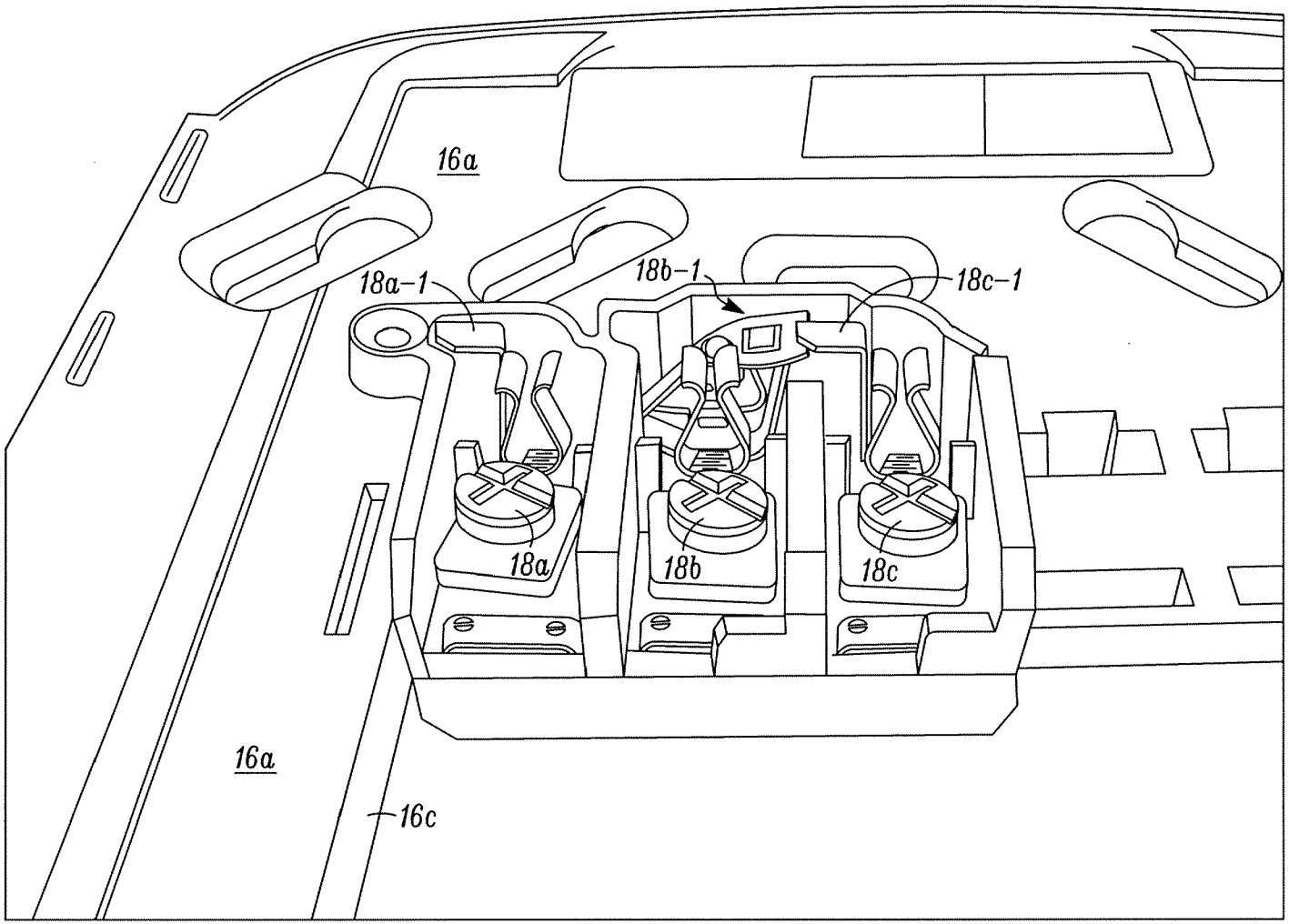
FIGS. 8A, 8B is an enlarged partial views of short circuited and open circuited terminals of an electrical unit such as the electrical unit of FIG. 5A.

Relative to the terminals 18, as best seen in FIGS. 8A, B, terminals 18*a*, 18*c* are substantially identical. Terminal 18*b* is unlike terminals 18*a*, 18*c*. Both terminals 18*a*, 18*c* include a contact member, such as 18*a*-1, 18*c*-1 which extends laterally therefrom. Terminal 18*b* carries a multi-element structure 18*b*-1.

Figure 9:
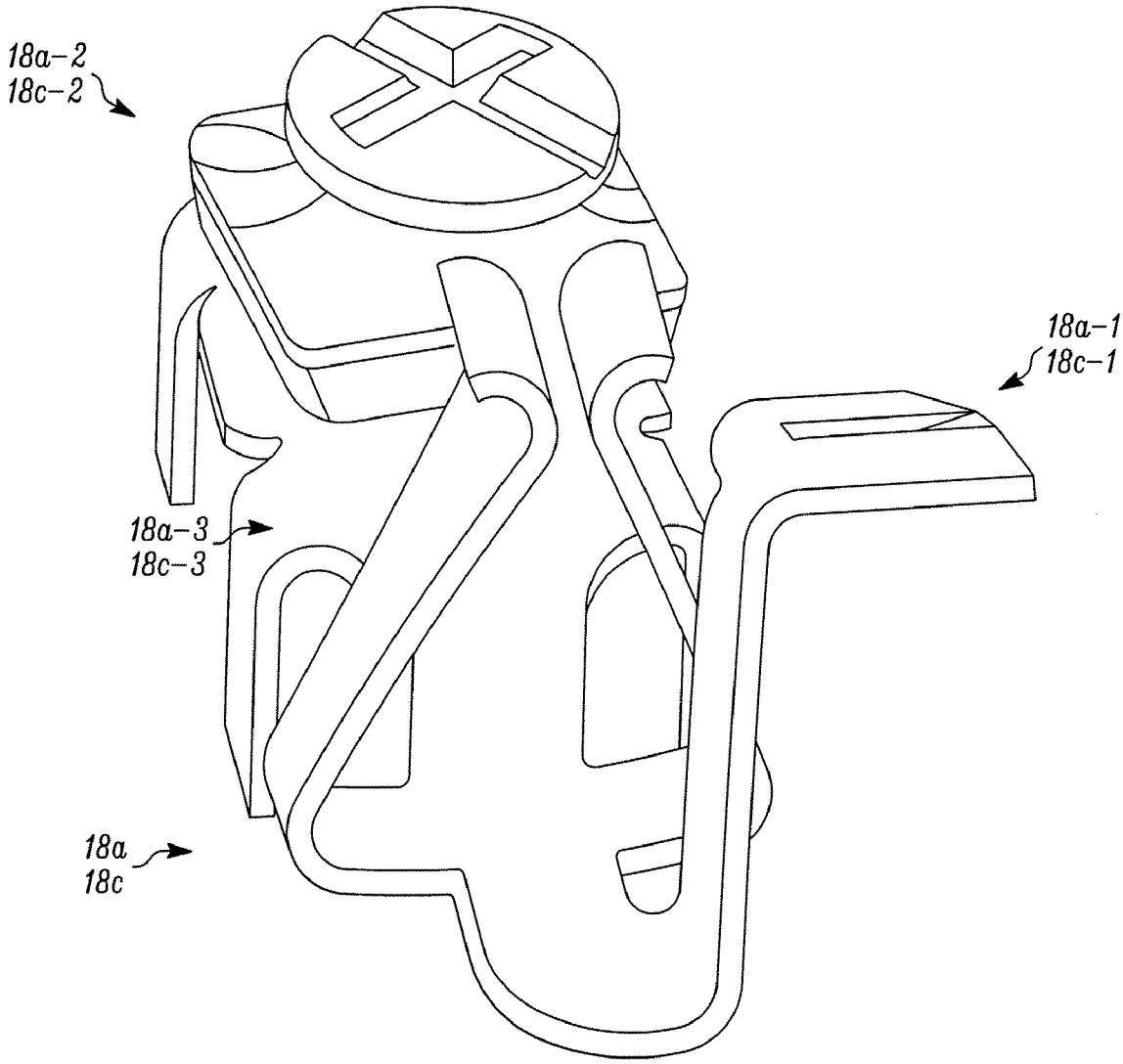
FIG. 9 is a perspective view of one of the terminals usable in the electrical unit of FIG. 8.

Elements 18*a*-1, 18*c*-1 are best seen in FIG. 9. Element 18*b*-1 is best seen in FIG. 10.

As illustrated in FIG. 9, terminals such as 18*a*, 18*c* carry the integrally formed laterally extending contact member 18*a*-1, 18*c*-1. They also carry a respective screw terminal such as 18*a*-2, 18*c*-2. A slidable contact 18*a*-3, 18*c*-3 is positioned between the screw terminal such as 18*a*-2 and the laterally extending 18*a*-1. The contacts 18*a*-3, 18*c*-3 slidably receive the members of the plurality 24.

Figure 8B:
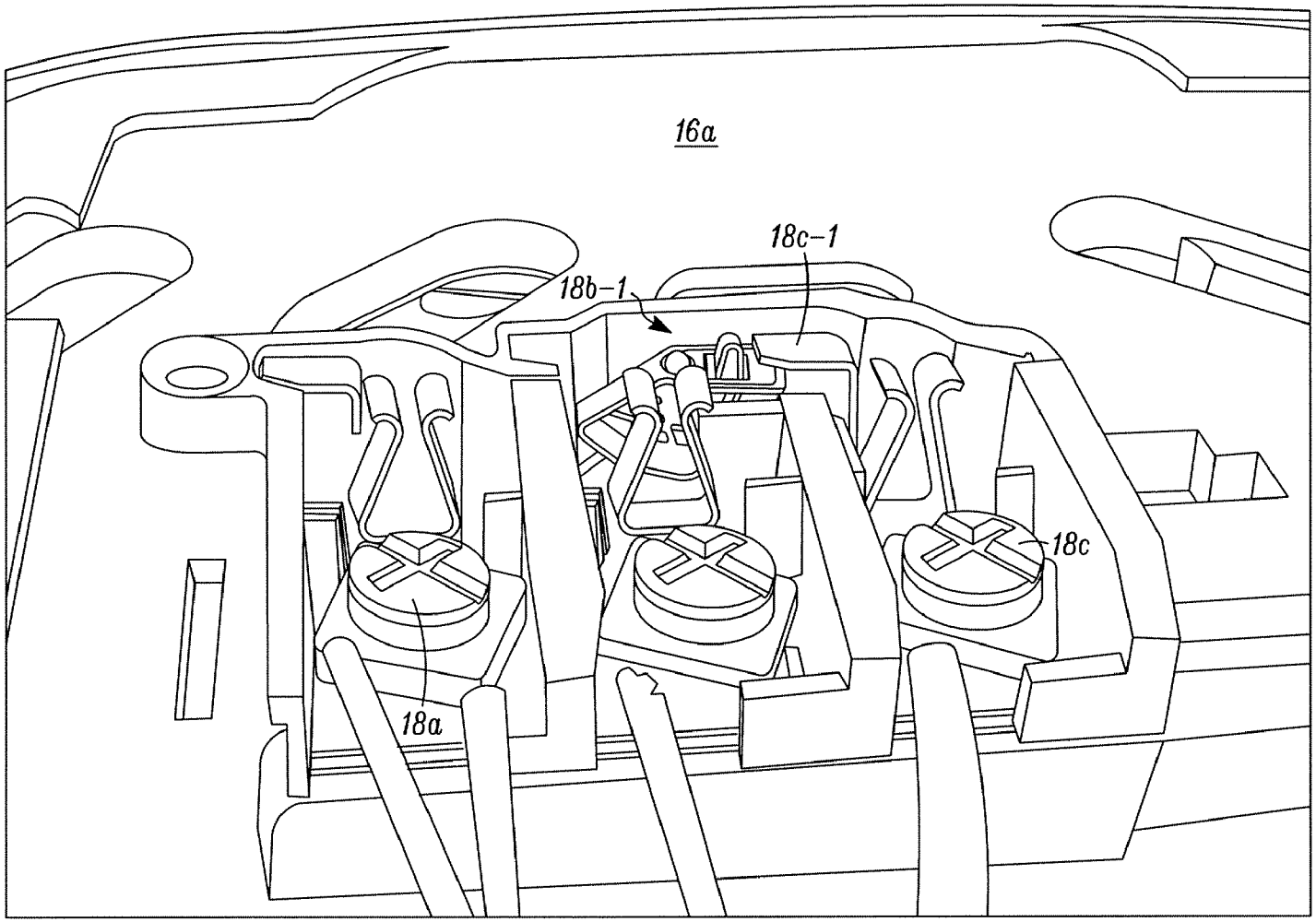
Figure 10:
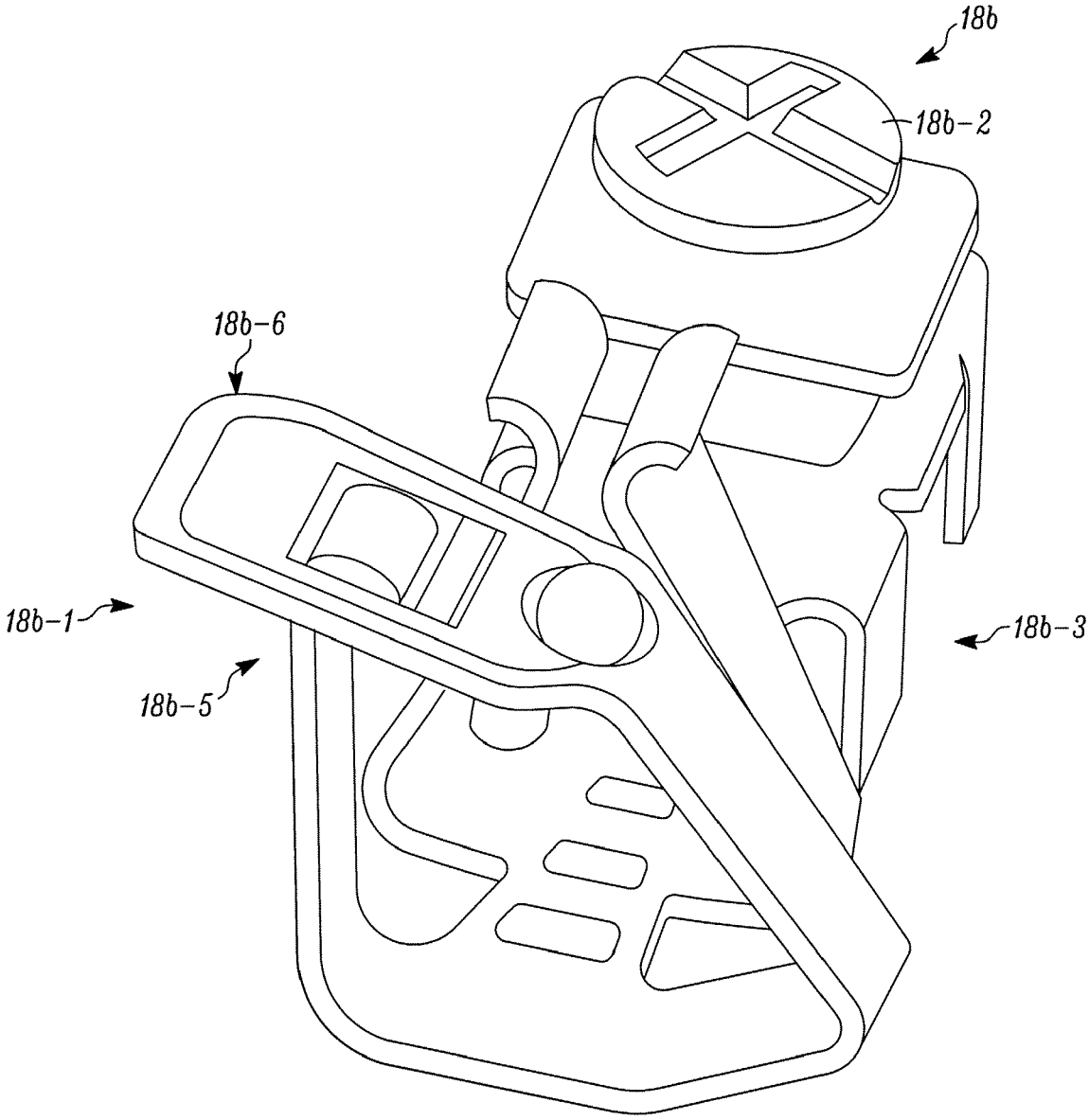
FIG. 10 is a perspective view of another electrical terminal usable with the unit of FIG. 8.

Relative to FIG. 10, the contact member 18*b*-1 has a U-shaped hook portion indicated generally at 18*b*-5 and a latchable contact portion 18*b*-6. The contact portion 18*b*-6 has a short circuit state; illustrated in FIG. 8A relative to contact member 18*c*-1 and an open circuit state FIG. 8B where the member 18*b*-6 does not contact the member 18*c*-1.

In the open circuit state, the latch mechanism 18*b*-5 holds the contact portion of 18*b*-6 in a retracted position relative to the contact 18*c*-1 thereby producing an open circuit state. The member 18*b*-6 is spring biased and can switch from the open circuit state to the closed circuit state, illustrated in FIG. 8, by displacing the latch member 18*b*-5 laterally relative to the contact member 18*b*-6. As illustrated in FIG. 10, the contact member 18*b*-6 is in its short circuit position, see FIG. 8.

The terminals 18*b*, 18*c* operate in conjunction with a force applying member 24*a* but seen in FIGS. 5A, B, of the electrical unit 14. As the electrical unit 14 engages the plate 12, the member 24*a* displaces contact member 18*b*-6 moving same toward the latch member 18*b*-5. The latch member engages the contact member 18*b*-6 and latches same into an open circuit condition. In this condition, the terminals 18*b*, 18*c* are open circuited relative to one another, and, the power supply and control circuitry 30*c* of the unit 14 can if desired, couple an electrical signal from one terminal to the other indicating that the unit 14 has been installed and is functioning properly.

When the unit 14 is removed from the base 12 the terminals 18*b*, 18*c* continue to remain open circuited. This results in a discontinuity in the respective wires and can be detected as indicative of a trouble condition caused by a missing electrical unit. For test purposes, an installer can manually release contacting member 18*b*-6 from latch member 18*b*-5 to produce a short circuit condition between terminals 18*b, c*. When the unit 14 is reinstalled on the base 12, the open circuit condition results between terminals 18*b, c*.

Figure 11:
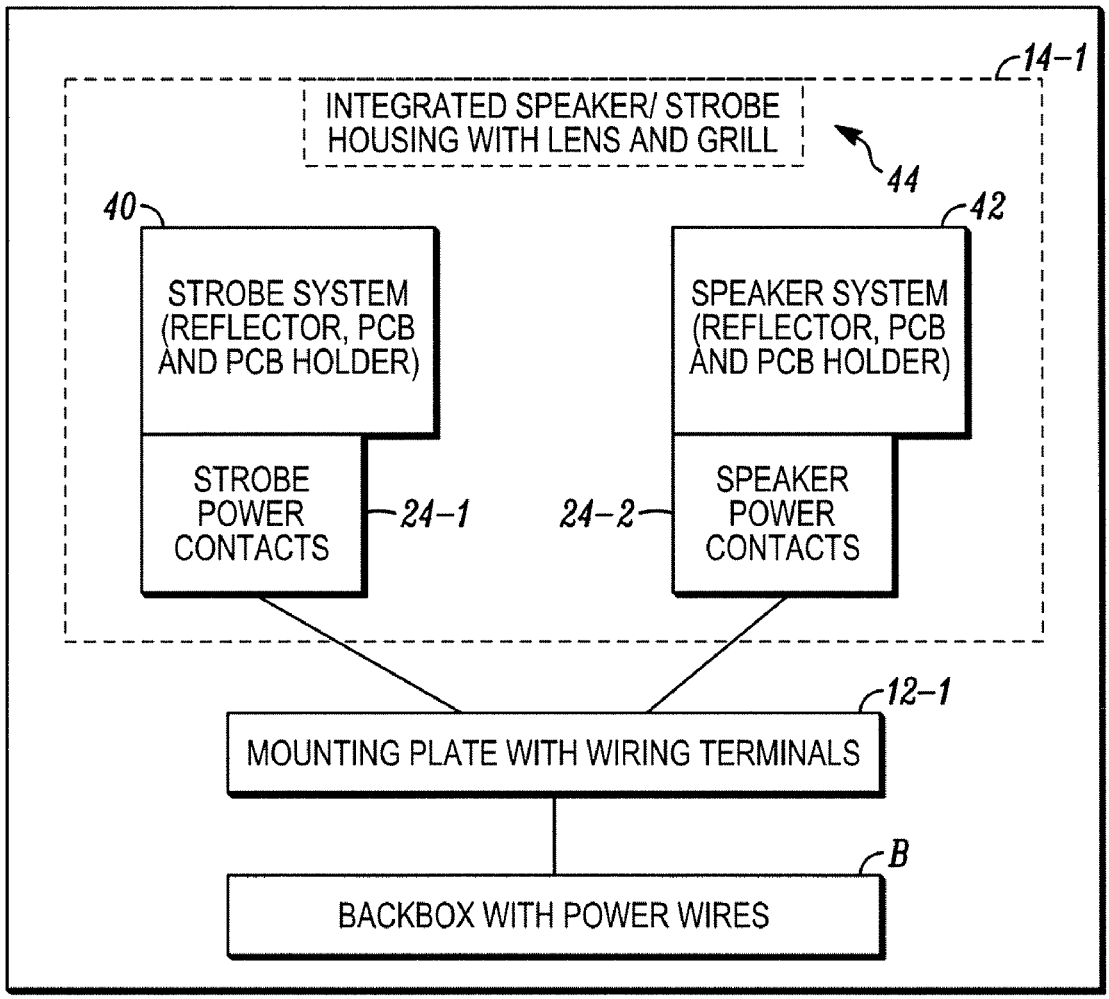
FIG. 11 illustrates details of an embodiment of the invention which incorporates a loud speaker and a strobe.
Figure 12:
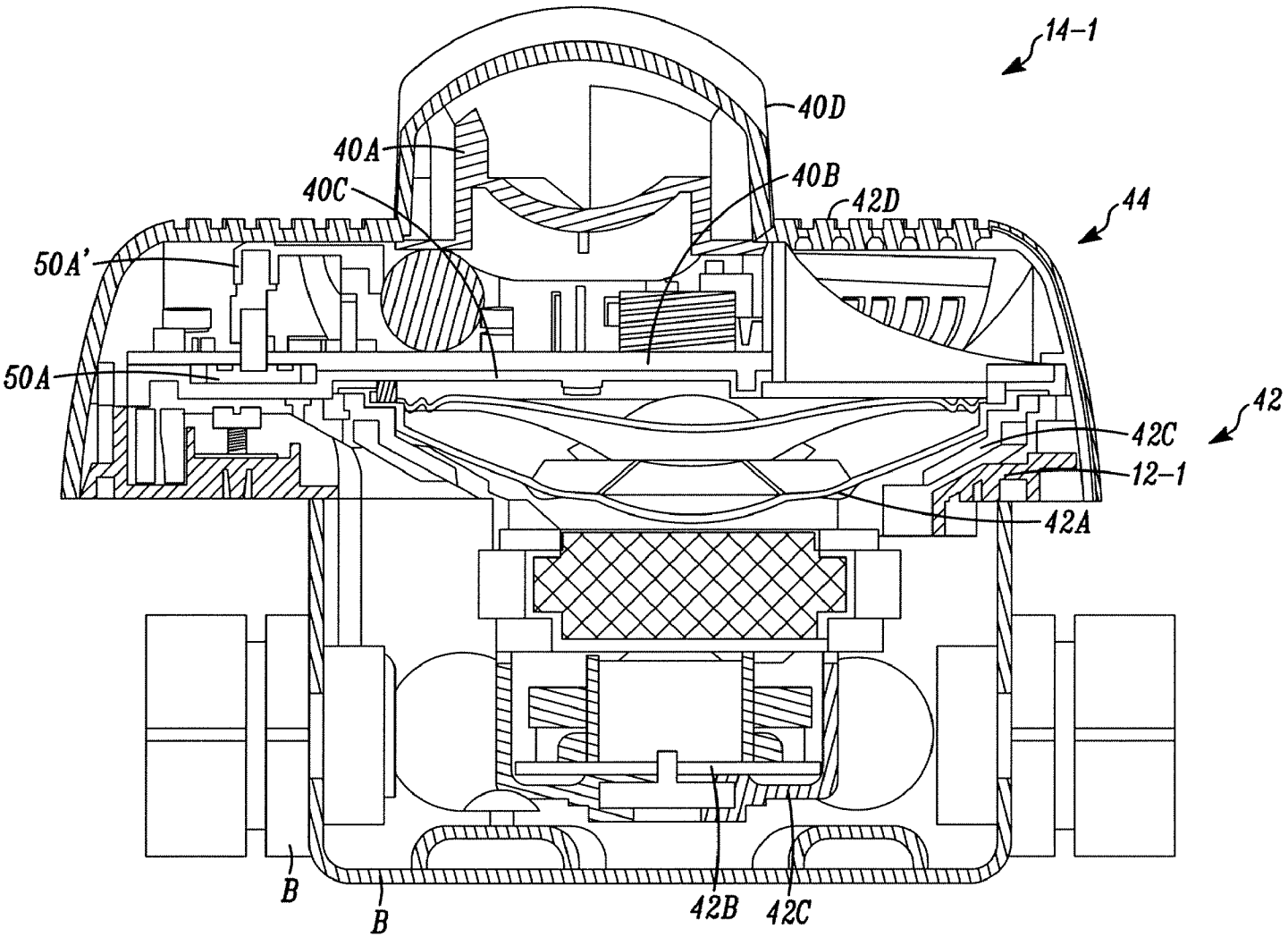
FIG. 12 is a sectional view illustrating details of the embodiment of FIG. 11 mounted on an electrical box.
Figure 13A:
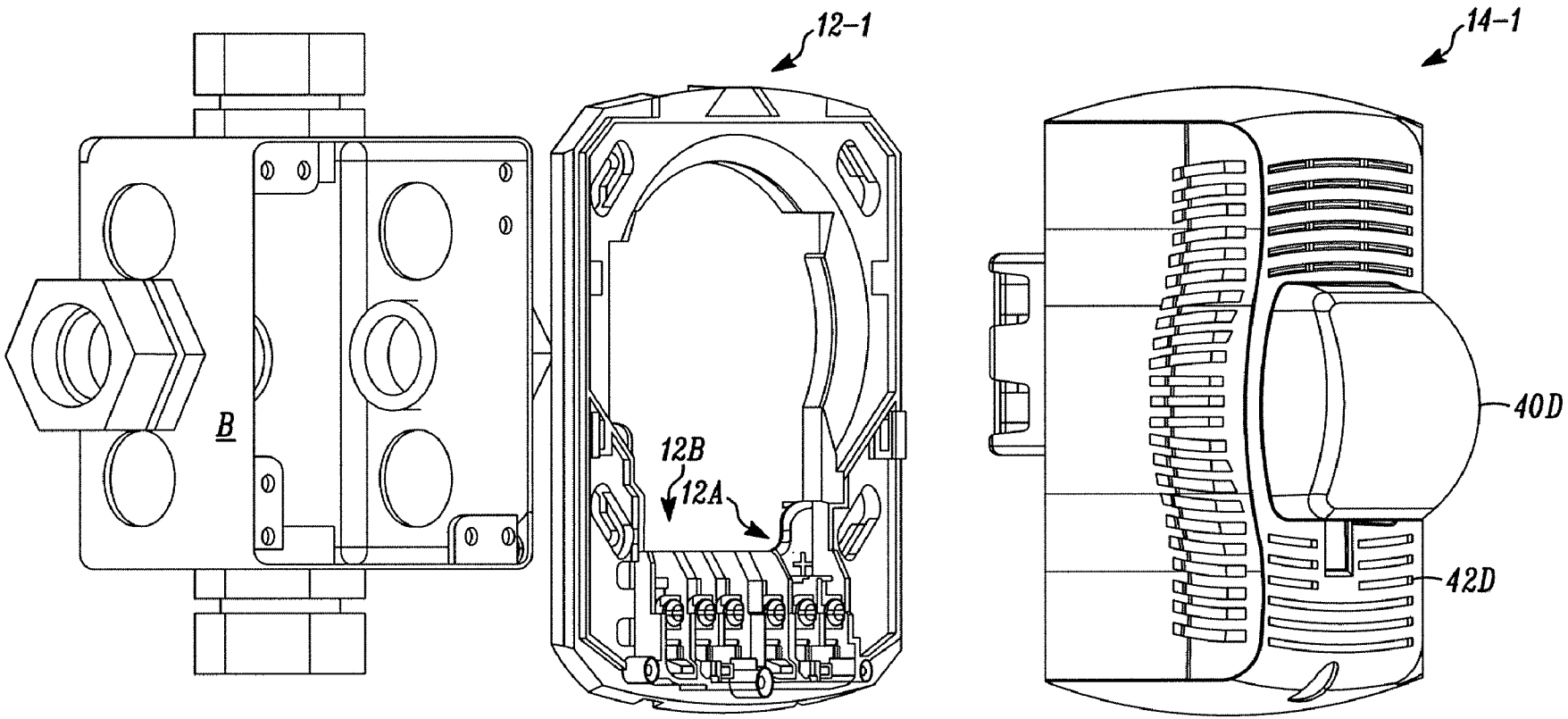
FIGS. 13A, B are exploded views of the embodiment of FIG. 11 from two different orientations.

FIG. 11 is a block diagram of a speaker/strobe embodiment of the invention 14-1. FIG. 12 is a view, in section illustrating appliance 14-1 mounted on the box B. FIGS. 13A, B are exploded views of the box B, wiring/mounting plate 12-1 and appliance 14-1.

FIG. 12 illustrates the advantages of using a pre-mounted wiring plate, such as the plate 12-1 given the way that the appliance 14-1 fills the box B. Plate 12-1 can be mounted on the electrical box B. Plate 12-1 can carry several strobe related wire terminal contacts 12*a* and several displaced speaker related wire terminal contacts 12*b*. Output appliance 14-1 can then be coupled to the mounting plate 12-1 as discussed previously.

Appliance 14-1 includes strobe power contacts 24-1, and displaced speaker power contacts 24-2 both of which correspond to previously discussed contacts 24. These mate with terminals 12*a, b* when the unit 14-1 is mounted on plate 12-1 as discussed previously. Strobe power contacts 24-1 are in turn coupled to a strobe system 40 which includes a flashable strobe light, a reflector 40*a*, both of which could be mounted on a printed circuit board (PCB) 40*b* and a PCB holder or support 40*c*.

Speaker power contacts 24-2 are coupled to a speaker system 42 which includes a loud speaker 42*a*, which can be used to output verbal messages into a region being monitored. The speaker 42*a* could be mounted on a PCB 42*b* as would be understood by those of skill in the art. The PCB 42*b* and speaker assembly 42*a* could be supported by a PCB holder or support 42*c*.

Figure 13B:
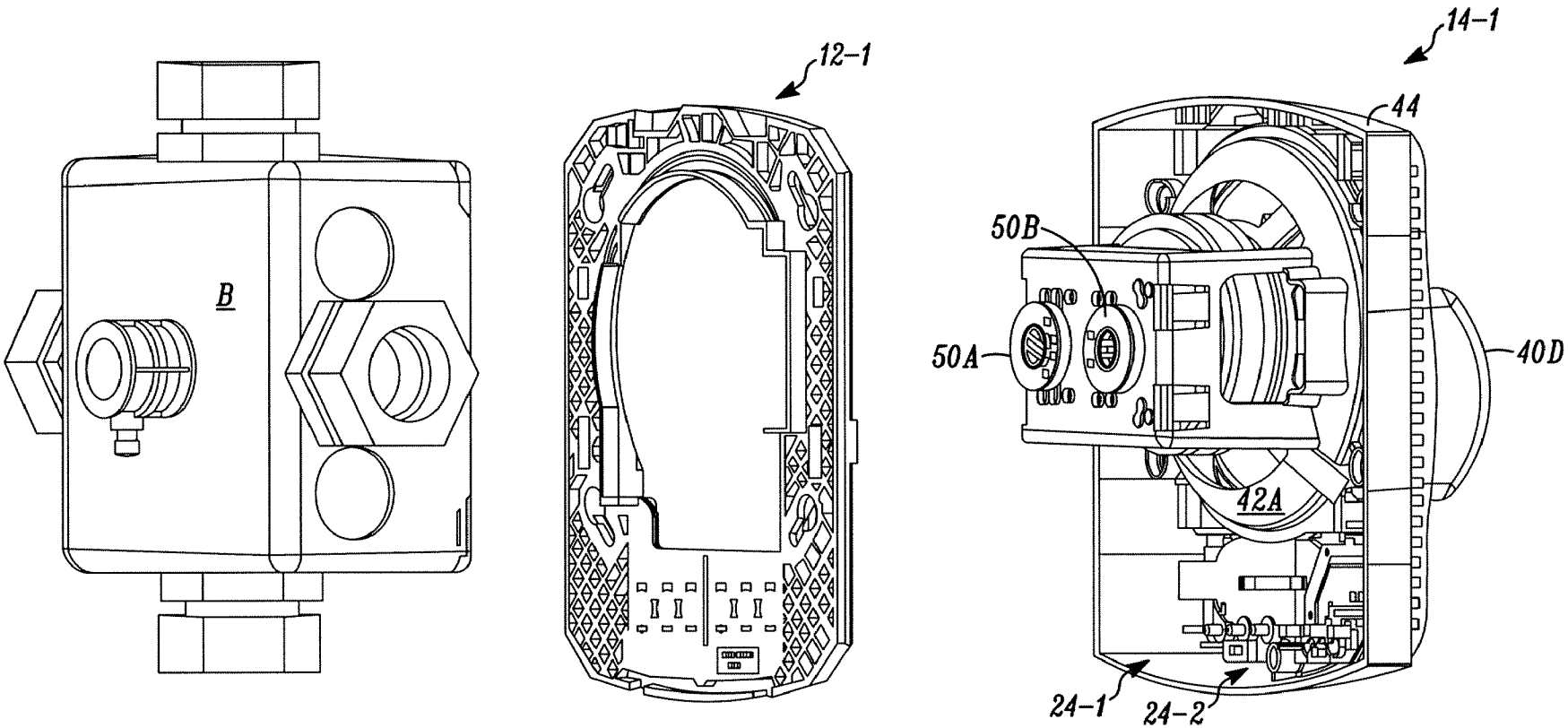

A housing 44 can carry a lens 40*d*, through which visible radiant energy from the strobe light passes, and a grill 42*d*, through which verbal messages pass upon being emitted by the speaker. As best seen in FIG. 13B, manually operable adjustments 50*a,b* can be provided, for example to set strobe output intensity, or speaker output volume, without limitation. An optical output indicator 50*a*', coupled to the adjustment member 50*a* can be viewed from the front of the unit 14-1. Those of skill will understand that the embodiment illustrated in FIGS. 11-13B could be implemented with only the speaker 42*a* without departing from the spirit and scope of the invention.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. An alarm notification device comprising:

a base with a plurality of wire receiving terminals and a plurality of unit engaging contacts, each terminal is coupled to a respective contact;

an alarm unit, the unit releasably engages the base and is electrically coupled to at least some of the terminals via the contacts when engaged; the alarm unit is movable along an axis that intersects the base, the alarm unit includes at least an audible output transducer; and said base carries a structure adjustable to a first orientation wherein said structure when in said first orientation short circuits a pair of terminals of said plurality of terminals to check system wiring, said structure is adjustable to a second orientation wherein in said second orientation said pair of terminals exhibits an open circuit with said structure, wherein the structure is in said second orientation responsive to the unit being removed from the base.

2. A device as in claim 1 where the unit carries a plurality of conductive elements, each of the elements engages a respective contact at least when the unit engages the base.

3. A device as in claim 1 where the unit carries a structure to adjust said structure carried by said base to said second orientation from said first orientation.

4. A device as in claim 1 where the structure can be locked into said second orientation.

5. A device as in claim 1 where the unit carries a plurality of unit terminations, at least some of the unit terminations slidably engage a respective engaging contact.

6. A device as in claim 1 where the unit is selected from a class which includes a horn, a voice output transducer, or a combination voice output transducer/strobe.

7. A device as in claim 5 where the unit terminations linearly slide or rotatably slide.

8. An apparatus comprising:

a substantially planar monitoring plate, the plate carrying a plurality of wire connectable terminals, two of the terminals carrying first and second shorting elements, the elements open circuit the terminals in response to an applied force; and a verbal and a visual output unit having a plurality of contacts, the unit engages the plate while moving in one of, a direction generally perpendicular to the plate, and, a direction generally parallel to the plate to electrically couple to at least some of the terminals via the contacts, and wherein engagement of the unit to the plate provides the force to open-circuit the terminals.

9. An apparatus as in claim 8 where the output unit carries a plurality of electrical contacts with at least some of the contacts releasably engaging at least some of the terminals.

10. An apparatus as in claim 8 where the contacts extend in the moving direction.

11. An apparatus as in claim 10 where the shorting elements are fixedly attached to respective terminals.

12. An apparatus as in claim 8 where the elements engage and short circuit the two terminals.

13. An apparatus as in claim 12 where the unit includes a loudspeaker.

14. An apparatus as in claim 13 where the unit includes a strobe light.

* * * * *